US010900140B2

(12) United States Patent
Özkaya et al.

(10) Patent No.: US 10,900,140 B2
(45) Date of Patent: Jan. 26, 2021

(54) METHOD FOR ELECTROLYTICALLY PASSIVATING AN OUTERMOST CHROMIUM OR OUTERMOST CHROMIUM ALLOY LAYER TO INCREASE CORROSION RESISTANCE THEREOF

(71) Applicant: Atotech Deutschland GmbH, Berlin (DE)

(72) Inventors: Berkem Özkaya, Berlin (DE); Philipp Wachter, Berlin (DE); Christina Pfirrmann, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 16/477,912

(22) PCT Filed: Feb. 12, 2018

(86) PCT No.: PCT/EP2018/053391
§ 371 (c)(1),
(2) Date: Jul. 15, 2019

(87) PCT Pub. No.: WO2018/146292
PCT Pub. Date: Aug. 16, 2018

(65) Prior Publication Data

US 2019/0352791 A1 Nov. 21, 2019

(30) Foreign Application Priority Data

Feb. 13, 2017 (EP) ..... 17155862

(51) Int. Cl.
*C25D 11/38* (2006.01)
*C25D 3/06* (2006.01)
*C25D 11/36* (2006.01)

(52) U.S. Cl.
CPC ..... *C25D 11/38* (2013.01); *C25D 3/06* (2013.01); *C25D 11/36* (2013.01)

(58) Field of Classification Search
CPC ..... C25D 11/36; C23C 2222/10
See application file for complete search history.

(56) References Cited

U.S. PATENT DOCUMENTS

| | | | | |
|---|---|---|---|---|
| 3,047,939 | A * | 8/1962 | Brown | C25D 5/14 428/637 |
| 4,167,460 | A | 9/1979 | Tomaszewski | |
| 6,004,448 | A | 12/1999 | Martyak | |
| 6,989,087 | B2 | 1/2006 | Lansdell et al. | |
| 8,435,360 | B2 | 5/2013 | Dingwerth et al. | |
| 9,738,790 | B2 | 8/2017 | Hofmann et al. | |
| 2006/0099439 | A1 | 5/2006 | Kochilla et al. | |
| 2010/0180793 | A1* | 7/2010 | Dingwerth | C23C 22/83 106/14.41 |
| 2011/0155286 | A1 | 6/2011 | Sugiura et al. | |
| 2011/0162556 | A1 | 7/2011 | Banda et al. | |
| 2013/0078382 | A1* | 3/2013 | Hofmann | C23C 22/362 427/372.2 |
| 2014/0154525 | A1 | 6/2014 | Van Schaik et al. | |
| 2015/0252487 | A1* | 9/2015 | Mertens | C25D 3/06 428/667 |

FOREIGN PATENT DOCUMENTS

| | | |
|---|---|---|
| CN | 1225397 A | 8/1999 |
| GB | 1482457 | 8/1977 |
| JP | 2009235456 | 10/2009 |
| JP | 2010209456 | 9/2010 |
| KR | 20030039641 A | 5/2003 |

OTHER PUBLICATIONS

PCT/EP2018/053391; PCT International Search Report and Written Opinion of the International Searching Authority dated Mar. 12, 2018.
Office Action for Chinese Patent Application No. 201880011009.9 dated Oct. 30, 2020.

* cited by examiner

*Primary Examiner* — Brian W Cohen
*Assistant Examiner* — Ho-Sung Chung
(74) *Attorney, Agent, or Firm* — Renner, Otto, Boisselle & Sklar, LLP

(57) ABSTRACT

A method for electrolytically passivating an outermost chromium or chromium alloy layer to increase corrosion resistance thereof, including steps of (i) providing a substrate comprising said outermost chromium or chromium alloy layer, (ii) providing or manufacturing an aqueous, acidic passivation solution comprising
trivalent chromium ions,
phosphate ions,
one or more organic acid residue anion, (iii) contacting the substrate with the passivation solution and passing an electrical current between the substrate as a cathode and an anode in the passivation solution such that a passivation layer is deposited onto the outermost layer, wherein the trivalent chromium ions are obtained by chemically reducing hexavalent chromium in presence of phosphoric acid and at least one reducing agent, with the proviso that during or after the chemical reducing the one or more than one organic acid residue anion is present for the first time in the passivation solution.

16 Claims, No Drawings

METHOD FOR ELECTROLYTICALLY PASSIVATING AN OUTERMOST CHROMIUM OR OUTERMOST CHROMIUM ALLOY LAYER TO INCREASE CORROSION RESISTANCE THEREOF

The present application is a U.S. National Stage Application based on and claiming benefit and priority under 35 U.S.C. § 371 of International Application No. PCT/EP2018/053391, filed 12 Feb. 2018, which in turn claims benefit of and priority to European Application No. 17155862.0 filed 13 Feb. 2017, the entirety of both of which is hereby incorporated herein by reference.

The present invention relates to a method for electrolytically passivating an outermost chromium or outermost chromium alloy layer to increase corrosion resistance thereof, in particular for an outermost chromium or outermost chromium alloy layer obtained from electrolytically deposited trivalent chromium.

Electrolytically deposited nickel and chromium layers on a metal substrate or plastic substrate are well known for decorative and functional purposes. It is also known that such substrates exhibit good and acceptable corrosion resistant, in particular if the outermost layer is obtained from hexavalent chromium.

However, hexavalent chromium, in particular chromic acid, is very toxic, carcinogen and an environmental hazard. In particular waste water processing is very costly and requires a lot of effort. Therefore, it is desired to minimize the utilization of hexavalent chromium. As a result, outermost chromium layers (including alloys thereof) obtained from hexavalent chromium, which typically exhibit a very good corrosion resistance and are manufactured by well-established procedures, are more and more replaced by outermost chromium layers obtained from trivalent chromium. Since then, there are ongoing efforts to optimize such chromium layers in order to arrive at properties being at least equivalent to chromium layers obtained from hexavalent chromium, for example in terms of corrosion resistance.

In order to optimize corrosion resistance of outermost chromium layers obtained from trivalent chromium, surface treatments such as immersion treatments and/or electrolytic passivation are typically applied.

US 2015/0252487 A1 relates to a method of imparting improved corrosion protection to chromium plated substrates, which have been plated with chromium from a $Cr^{+3}$ plating bath, claiming a method of treating a substrate, wherein the substrate comprises a plated layer comprising chromium deposited from a trivalent chromium electrolyte, the method comprising the steps of:

(a) providing an anode and the substrate as a cathode in an electrolyte comprising (i) a trivalent chromium salt; and (ii) a complexant;

(b) passing an electrical current between the anode and the cathode to deposit a passivate film on the substrate".

JP 2009-235456 A relates to (i) an electrolytic treatment solution for a chromium-plated film formed from a trivalent-chromium plating solution and (ii) a method for electrolytically treating a chromium-plated film formed from trivalent-chromium plating solution wherein the solution comprises a water-soluble trivalent chromium compound, for example chromium sulphate, basic chromium sulphate, chromium nitrate, chromium acetate, chromium chloride, and chromium phosphate. It discloses further that an article is electrolytically treated as a cathode.

JP 2010-209456 A relates to an immersion treatment solution for preventing rusting of a chromium-plated film, and to a method for performing a treatment to prevent rusting of a chromium-plated film (rust-preventing treatment method) in which the treatment solution is used wherein the method can be applied to a hexavalent chromium-plated film or a trivalent chromium-plated film.

WO 2008/151829 A1 relates to a method for creating an anticorrosive coating layer, wherein a surface to be treated is brought into contact with an aqueous treatment solution comprising chromium(III) ions and at least one phosphate compound, wherein the ratio of the concentration of the substance amount of chromium(III) ions to the concentration of the at least one phosphate compound (calculated in relation to orthophosphate) lies between 1:1.5 and 1:3. The method improves anticorrosive protection of metal surfaces, particularly metal surfaces containing zinc, provided with conversion layers. The chromium(III) ions are either provided by inorganic chromium(III) salts or by means of reducing suitable hexavalent chromium compounds.

WO 2011/147447 A1 relates to a process for producing essentially chromium(VI)-free corrosion protection layers on surfaces of zinc, aluminium or magnesium and also alloys of these metals. The surface to be treated is brought into contact in direct succession with two aqueous treatment solutions containing chromium(III) ions, metal ions of the substrate surface to be treated and at least one complexing agent. The first treatment solution has a pH in the range from 1.0 to 4.0, while the second treatment solution has a pH of from 3.0 to 12.0. Claim 12 discloses that the passivating treatment in step 1 is aided by connecting the substrate as cathode in the passivation solution.

U.S. Pat. No. 6,004,448 A relates to a soluble composition of matter and process for electrolytically depositing a chromium oxide coating on a metal substrate from a bath containing a trivalent chromium compound.

Presently, substrates comprising an outermost chromium or outermost chromium alloy layer deposited from Cr-III based electrolytes provide in some cases ideally a corrosion resistance of approximately 300 hours in commonly standardized neutral salt spray tests (NSS test).

However, requirements in corrosion resistance are continually increasing in order to obtain even better corrosion protected substrates comprising said outermost chromium layers. Despite the above mentioned efforts, there is an ongoing demand to further increase the corrosion resistance obtained by methods known in the art, such as mentioned above. It is in particular desired and demanded to obtain a corrosion resistance easily exceeding 480 hours in said commonly standardized neutral salt spray tests, preferably exceeding 600 hours or even exceeding 800 hours.

It was therefore the primary objective of the present invention, based on the above mentioned prior art, to further increase corrosion resistance of substrates comprising an outermost chromium or outermost chromium alloy layer and at the same time maintaining a glossy and in particular a homogeneous optical appearance of said outermost layers for e.g. decorative applications. In particular, the corrosion resistance should at least exceed 480 hours in said commonly standardized neutral salt spray tests, preferably exceed 600 hours and most preferably exceed even 800 hours.

The above mentioned objective is solved by a method for electrolytically passivating an outermost chromium or outermost chromium alloy layer to increase corrosion resistance thereof, the method comprising the steps of (i) providing a substrate comprising said outermost chromium or outermost chromium alloy layer, (ii) providing or manufacturing an aqueous, acidic passivation solution, the solution comprising
trivalent chromium ions,
phosphate ions,
one or more than one organic acid residue anion, (iii) contacting the substrate with the passivation solution and passing an electrical current between the substrate as a cathode and an anode in the passivation solution such that a passivation layer is deposited onto the outermost layer, wherein in the passivation solution said trivalent chromium ions are obtained by chemically reducing hexavalent chromium in the presence of phosphoric acid through at least one reducing agent selected from the group consisting of hydrogen peroxide and organic reducing agents, with the proviso that during or after the chemical reducing the one or more than one organic acid residue anion is present for the first time in the passivation solution.

Own experiments have shown that the way of providing said trivalent chromium ions largely affects the extent and quality of said corrosion resistance. The passivation solution utilized in step (iii) of the method of the present invention for passivation typically does not contain any more hexavalent chromium and, thus, does not exhibit the toxic and harmful characteristics typically caused by or related to passivation solutions comprising hexavalent chromium for depositing a passivation layer. Thus, it is possible to improve the operating conditions in view of health and environmental aspects if hexavalent chromium is merely used as a starting material.

Several methods are known in the art to provide an aqueous solution comprising trivalent chromium ions. As shown in some of the cited documents above, such ions are easily obtained by dissolving respective trivalent chromium salts, i.e. using trivalent chromium salts as a source for trivalent chromium ions (see above e.g. JP 2009-235456 A and JP 2010-209456 A).

Reducing hexavalent chromium to obtain trivalent chromium ions is also known. For example, EP 2 322 482 A1 relates to a chromium (III)-containing aqueous solution, which is useful for chromium plating or metal surface treatment, such as trivalent chromium chemical conversion treatment, and to a process for producing the same. However, EP'482 does not disclose electrolytically passivating an outermost chromium layer in order to increase corrosion resistance thereof.

We surprisingly found that an utilization of such trivalent chromium ions in an aqueous, acidic passivation solution for electrolytically passivating an outermost chromium or outermost chromium alloy layer dramatically increases the corrosion resistance of said outermost layer compared to the corrosion resistance resulting from an identically composed aqueous, acidic passivation solution but containing trivalent chromium ions obtained from dissolved trivalent chromium salts (for example as disclosed in JP 2009-235456 A and JP 2010-209456 A). Experiments show that corrosion resistance increases from approximately 300 hours in commonly standardized neutral salt spray tests to even up to 700 hours and more (see Examples below).

In the method of the present invention it is not yet fully understood what kind of trivalent chromium ion complexes are present in the aqueous, acidic passivation solution after the chemical reducing is carried out. It is assumed that chromium (III) salt complexes having at least a phosphoric acid radical and an organic acid radical bonded to the chromium atom are formed. It is furthermore assumed that the formation of such complexes occur more quickly and more quantitatively compared to a complex formed by dissolving trivalent chromium salts as the only source for trivalent chromium ions. This supposedly affects the charge distribution in the entire solution. According to own experiments, an aqueous, acidic passivation solution as defined in the method of the present invention exhibits the desired properties for electrolytically passivating an outermost chromium or outermost chromium alloy layer to significantly increase corrosion resistance thereof.

The method of the present invention comprises at least two preparation steps, steps (i) and (ii); step (iii) is the actual passivation step. After step (iii) a passivated outermost layer is obtained, providing significantly increased corrosion resistance compared to a substrate with an outermost chromium or outermost chromium alloy layer which is not passivated and even compared to a substrate with an outermost chromium or outermost chromium alloy layer which is passivated as defined e.g. in JP 2009-235456 A and JP 2010-209456 A (see examples).

In the context of the present invention the term "at least one" is exchangeable with the term "one, two, three or more than three". The word "manufacturing" means that by one or more than one manufacturing step the respective result or product is obtained. Typically, "providing" includes "manufacturing".

In step (i) of the method of the present invention the substrate comprising said outermost chromium or outermost chromium alloy layer (throughout the present text frequently abbreviated as "the outermost layer") is provided.

A method of the present invention is preferred, wherein in step (i) the outermost layer is (a) directly on a surface of a base-substrate to form the substrate as defined in step (i), or (b) a layer of a layer stack, the layer stack being on a surface of a base-substrate and preferably comprising one or more than one layer selected from the group consisting of nickel layer, nickel alloy layer, copper layer, copper alloy layer, and noble metal seed layer.

If the outermost layer is a layer of such a layer stack, the layer stack is on a surface of said base-substrate, wherein said base-substrate and said layer stack together form the substrate as defined in step (i) of the method of the present invention.

In some cases it is preferred that one or more than one layer in the layer stack (preferably a nickel or nickel alloy layer) additionally comprises non-conductive particles, preferably silicon dioxide particles and/or aluminium oxide particles.

The base-substrate is preferably a metal base-substrate or an organic base-substrate.

Preferably, the metal base-substrate comprises one or more than one metal selected from the group consisting of iron, magnesium, nickel, zinc, aluminium, and copper, preferably iron, copper, and zinc. More preferred are in many cases metal alloy base-substrates of the aforementioned metals.

Most preferred is a method of the present invention wherein the metal base-substrate is selected from the group consisting of steel substrates, zinc based die cast substrates, brass substrates, copper substrates, and aluminium substrates. Zinc based die cast substrates typically comprise more than one or all elements of zinc, aluminium, magnesium, and copper. Typical trade marks for such products are for example ZAMAC and Superloy.

Brass substrates with an outermost chromium or outermost chromium alloy layer are in particular used in manufacturing sanitary equipment. Steel substrates and zinc based die cast substrates are typically used in a huge variety of articles and usually exhibit said outermost chromium or outermost chromium alloy layer for decorative purposes.

In some cases a method of the present invention is preferred, wherein the outermost layer is directly on a surface of a base-substrate, wherein the base-substrate is a metal base-substrate, more preferably the metal base-substrate comprises iron, most preferably the metal base-substrate is a steel substrate. An outermost chromium or outermost chromium alloy layer directly on a surface of a steel substrate typically exhibits very good tribological characteristics. In many cases it is desired to additionally increase corrosion resistance of such a substrate, preferably by the method of the present invention.

The method of the present invention is in particular beneficial if the base-substrate is a metal base-substrate, preferably a metal alloy base-substrate, more preferably each as defined above. Such base-substrates in particular need a long lasting corrosion resistance. However, the passivation layer obtained by the method of the present invention also protects an outermost chromium or outermost chromium alloy layer deposited onto an organic base-substrate from corrosive damage and optical deterioration.

Preferably, the organic base-substrate is selected from the group consisting of plastics, more preferably selected from the group of plastics consisting of acrylnitril butadiene styrol (ABS), acrylnitril butadien styrol polycarbonate (ABS-PC), polypropylene (PP), and polyamide (PA).

Organic base-substrates are also used for manufacturing sanitary equipment and a huge variety of articles utilized in the automotive industry, thereby mimicking metal or metal alloy base-substrates.

Typically, organic base-substrates are first rendered conductive by means of a seed layer for subsequent metallization. Such a seed layer is usually a metal layer deposited by electroless deposition. In the context of the present invention, such a seed layer belongs to the above mentioned layer stack. Preferably, the seed layer is a copper layer or a noble metal seed layer. A preferred noble metal seed layer is selected from the group consisting of palladium layer and silver layer.

In many cases the outermost layer is a layer of a layer stack, the layer stack being on the surface of the base-substrate, most preferably if the base-substrate is an organic base-substrate.

However, if the base-substrate comprises nickel or the layer stack comprises a nickel and/or nickel alloy layer it is preferred that the outermost layer in step (i) of the method of the present invention is on a copper or copper alloy layer. This might be beneficial if the substrate of step (i) regularly comes into contact with human skin. As a result, allergic nickel reactions can potentially be reduced or even prevented. Preferably, for such articles no nickel (including nickel layers and nickel alloy layers) is used at all.

In many cases a method of the present invention is preferred, wherein the layer stack comprises a copper or copper alloy layer, and thereon one or more than one nickel or nickel alloy layer, and thereon said outermost layer as defined in step (i) of the method of the present invention. The base substrate is preferably a metal alloy base-substrate, more preferably containing zinc, or an organic base substrate, preferably as described above.

A method of the present invention is preferred, wherein the outermost layer has a maximum layer thickness of 500 nm or less, preferably 400 nm or less. Such a layer thickness is typical for decorative chromium or chromium alloy layers. In the method of the present invention it is preferred that the outermost layer is such a decorative layer.

In step (i) of the method of the present invention, "chromium layer" refers to a layer of pure chromium, i.e. other chemical elements except chromium are not intentionally added or present. "Chromium alloy layer" refers to a chromium layer comprising intentionally added or present further chemical elements other than chromium in order to form a respective alloy. In step (i) an outermost chromium alloy layer is preferred. Preferred alloying elements are selected from the group consisting of iron, carbon, oxygen, sulfur, and mixtures thereof. In some cases a method of the present invention is preferred, wherein the total amount of alloying elements in the outermost chromium alloy layer is 25 atom-% or less, based on the total amount of atoms in the outermost chromium alloy layer.

Preferred is a method of the present invention wherein the total amount of sulfur in the outermost layer is in the range from 0 to 10 atom-%, based on the total amount of atoms in the outermost layer, preferably 0 to 4 atom-%.

In some cases a method of the present invention is preferred, wherein the outermost layer contains iron in a total amount of 10 atom-% or less, based on the total amount of atoms in the outermost layer, preferably 0.1 atom-% or less (including no iron at all). Typically, such an outermost layer (having at the same time a total amount of chromium of 75 atom-% or more) exhibits a glossy and bright appearance, preferably having an appearance defined by L* in the range from 79 to 86, a* in the range from −0.4 to +0.4, and b* in the range from 0.1 to 2.5.

"Outermost chromium or outermost chromium alloy layer" means that in step (i) no additional metal or metal alloy layer is deposited or present on said outermost layer. Preferably, no other passivation layer is present on said outermost layer. However, this does not exclude a cleaning or a pre-treatment of the outermost chromium or outermost chromium alloy layer prior to step (iii).

A preferred pre-treatment of the outermost layer is disclosed in JP 2010-209456 A, paragraphs [0015] to [0027], wherein paragraphs [0015] to [0021] disclose an aqueous immersion treatment solution and paragraphs [0022] to [0027] a rust-preventing treatment method utilizing said aqueous immersion treatment solution. Such an aqueous immersion treatment solution preferably has a pH in the range from 1 to 3, preferably 1 to 1.5, and comprises water-soluble trivalent chromium phosphate and phosphoric acid. The total amount of trivalent chromium ions is in the range from 1 g/L to 50 g/L, based on the total volume of the aqueous immersion treatment solution, preferably from 8 g/L to 12 g/L. Optionally, the aqueous immersion treatment solution comprises in an amount of 10 g/L to 100 g/L, based on the total volume of the aqueous immersion treatment solution, one or more than one pH-buffering compound, preferably one or more than one water-soluble aliphatic organic acid, more preferably selected from the group consisting of formic acid, acetic acid, oxalic acid, malonic acid, succinic acid, gluconic acid, malic acid, citric acid, and water-soluble salts thereof, preferably sodium and/or potassium salts thereof. In some cases of the method of the present the substrate as defined in step (i) is preferably immersed into such an aqueous immersion treatment solution for 3 to 120 seconds prior to step (iii), preferably for 5 to 30 seconds. During immersion, the temperature of the aqueous immersion treatment solution is preferably in the range from 20° C. to 50° C., more preferably in the range from 20° C. to 35° C. After the pre-treatment it is preferred that the substrate is thoroughly rinsed with DI water.

The method of the present invention can be applied to any outermost chromium or outermost chromium alloy layer, regardless whether obtained from trivalent chromium ions or hexavalent chromium. However, a method of the present invention is preferred, wherein in step (i) the outermost layer is obtained from electrolytically deposited trivalent chromium ions. According to own experiments the method of the present invention is in particular beneficial for an outermost layer obtained from electrolytically deposited trivalent chromium ions. A corrosion resistance almost identical or even better compared to the corrosion resistance of an outermost layer obtained from hexavalent chromium (without a passivation) was obtained.

Preferably, in the outermost chromium alloy layer the total amount of chromium is at least 45 atom-%, based on the total amount of atoms in the outermost chromium alloy layer. Thus, a method of the present invention (as described above, preferably as described as being preferred) is preferred, wherein in step (i) the outermost chromium alloy layer comprises a total amount of chromium of 45 atom-% or more, based on the total amount of atoms in the outermost chromium alloy layer, preferably 60 atom-% or more, more preferably 75 atom-% or more.

In step (ii) of the method of the present invention, the aqueous, acidic passivation solution is provided or manufactured.

The following parameters and characteristics of the aqueous, acidic passivation solution typically refer to the final state of the solution, ready for utilization in step (iii) of the method of the present invention (i.e. after the chemical reducing has been carried out). Thus, the term "providing" refers to an aqueous, acidic passivation solution ready for utilization in step (iii) of the method of the present invention.

Preferred is a method of the present invention, wherein the pH of the aqueous, acidic passivation solution is in the range from 3 to 5, preferably 3 to 4. The pH is determined at 20° C. If the pH is significantly above 5, an undesired precipitation is observed in the passivation solution. If the pH is significantly below 3, corrosion resistance is reduced in commonly standardized neutral salt spray tests compared to the corrosion resistance obtained by a passivation solution exhibiting a pH in the range from 3 to 5, and undesired changes in the optical appearance of the outermost layer are observed. Preferably, the above mentioned pH-range is obtained and/or maintained by adding a hydroxide, preferably sodium hydroxide.

Preferred is a method of the present invention, wherein the total amount of trivalent chromium ions in the aqueous, acidic passivation solution is in the range from 0.1 g/L to 50 g/L, based on the total volume of the aqueous, acidic passivation solution, preferably 1 g/L to 25 g/L, more preferably 1 g/L to 10 g/L, even more preferably 1 g/L to 7 g/L, most preferably 2 g/L to 7 g/L. Said total amount is based on a molecular weight of 52 g/mol for chromium. If the total amount of trivalent chromium ions is significantly below 0.1 g/L, no passivation effect is observed. If the total amount significantly exceeds 50 g/L undesired changes in the optical appearance of the outermost layer, such as stains and blurs, are frequently observed. Furthermore, above 50 g/L, the passivation process is usually not anymore cost efficient.

In the context of the present invention, "trivalent chromium" refers to chromium with the oxidation number +3. The term "trivalent chromium ions" refers to $Cr^{3+}$-ions in a free or complexed form. Likewise, "hexavalent chromium" refers to chromium with the oxidation number +6, "hexavalent chromium compounds" in particular to compounds containing such hexavalent chromium.

Preferred is a method of the present invention, wherein the total amount of phosphate ions in the aqueous, acidic passivation solution is in the range from 1 g/L to 90 g/L, based on the total volume of the passivation solution, preferably 2 g/L to 50 g/L, more preferably 5 g/L to 40 g/L, most preferably 8 g/L to 30 g/L. Said total amount is based on a molecular weight of 95 g/mol for phosphate ions ($PO_4^{3-}$). In the aqueous, acidic passivation solution utilized in the method of the present invention, phosphate ions preferably form complexes with trivalent chromium ions or at least are protonated according to the acidic pH of the aqueous, acidic passivation solution (e.g. $H_2PO_4^-$ at pH 3.5).

The aqueous, acidic passivation solution comprises one or more than one organic acid residue anion, primarily for complexing purposes. In the aqueous, acidic passivation solution the one or more than one organic acid residue anion is protonated (i.e. is present as the respective organic acid) or deprotonated (i.e. is present as the respective organic acid residue anion), depending on the solution's pH, the acid dissociation constant of the respective organic acid, and the complexes including said organic acid residue anions. If the organic acid residue anion is an organic acid residue anion with more than one carboxylic group, the anion may be partly protonated/deprotonated, respectively.

In the method of the present invention it is preferred that the aqueous, acidic passivation solution comprises only one organic acid residue anion, most preferably a dicarboxylic organic acid residue anion.

Preferred is a method of the present invention, wherein the one or more than one organic acid residue anion in the aqueous, acidic passivation solution is

- selected from the group consisting of organic acid residue anions having one carboxylic moiety, carboxylic acid residue anions having two carboxylic moieties, and carboxylic acid residue anions having three carboxylic moieties,
- preferably selected from the group consisting of carboxylic acid residue anions having two carboxylic moieties,
- more preferably anions from organic acids selected from the group consisting of oxalic acid, malonic acid, succinic acid, glutaric acid, malic acid, and tartaric acid,
- most preferably oxalate.

Preferred is a method of the present invention, wherein the total amount of the one or more than one organic acid residue anion in the aqueous, acidic passivation solution is in the range from 1 g/L to 30 g/L, based on the total volume of the aqueous, acidic passivation solution, preferably 2 g/L to 14 g/L, more preferably 6 g/L to 12 g/L. The total amount is determined based on the fully protonated, non-complexed, monomeric form of the corresponding organic acid. If the total amount is significantly below 1 g/L, no sufficient passivation effect is observed. If the total amount significantly exceeds 30 g/L, undesired changes in the optical appearance of the outermost layer, such as stains and blurs, are sometimes observed as well as an insufficient passivation effect.

Preferred is a method of the present invention, wherein the aqueous, acidic passivation solution utilized in step (iii) does not contain hexavalent chromium compounds, preferably does not contain hexavalent chromium compounds and aluminium compounds, more preferably does not contain hexavalent chromium compounds, aluminium compounds, molybdenum compounds, vanadium compounds, and mercury compounds. According to own experiments it is assumed that aluminium compounds, molybdenum compounds, vanadium compounds, and mercury compounds may negatively interfere with the method for determining and analyzing hexavalent chromium. Furthermore, in some cases the passivation solution does preferably not contain molybdenum, tungsten, and ions of elements of group 7 (e.g. manganese) to group 12 (e.g. zinc) of the periodic system of elements. It some cases it is in particular preferred that the passivation solution does not contain copper ions, zinc ions, nickel ions, and iron ions. This means that such ions are not intentionally added or present.

Typically, hexavalent chromium is determined and analyzed (including its quantification) by means of the commonly known diphenylcarbazide method. The term "does not contain hexavalent chromium compounds" denotes that in the aqueous, acidic passivation solution utilized in step (iii) of the method of the present invention, hexavalent chromium is not detectable by means of said method. According to own experiments it is assumed that the total amount of hexavalent chromium compounds in the aqueous, acidic passivation solution is far below 1 ppm, based on the total weight of the aqueous, acidic passivation solution (and is therefore usually below the detection limit).

Preferred is a method of the present invention, wherein the aqueous, acidic passivation solution does not additionally contain trivalent chromium ions obtained from dissolving trivalent chromium salts.

Preferred is a method of the present invention, wherein the aqueous, acidic passivation solution does not contain boric acid, preferably does not contain boron containing compounds. This typically means that such compounds are not intentionally added or present in the passivation solution.

Preferred is a method of the present invention, wherein the aqueous, acidic passivation solution does not contain thiocyanate, preferably does not contain sulfur containing compounds comprising a sulfur atom having an oxidation state below +6. However, this means that the passivation solution for example may contain sulfate ions (oxidation state of +6), for example as anion of a conductive salt (for conductive salts see text below).

Preferred is a method of the present invention, wherein the aqueous, acidic passivation solution comprises one or more than one conductive salt. Preferably, the conductivity of the passivation solution is in the range from 1 mS/cm to 30 mS/cm, determined at 25° C. The one or more than one conductive salt is preferably selected from the group consisting of sulfate containing salts, nitrate containing salts, and perchlorate containing salts. Most preferably, the cation of the one or more than one conductive salt is sodium. Thus, most preferably the one or more than one conductive salt is selected from the group consisting of sodium sulfate, sodium nitrate, and sodium perchlorate. In some cases a method of the present invention is preferred, wherein the cation is not selected from the group consisting of potassium, ammonium, and magnesium, more preferably is not selected from the group consisting of potassium, ammonium, magnesium, calcium, strontium, and barium, most preferably is not selected from the group consisting of potassium, ammonium, and alkaline earth metals. This means that the passivation solution in the method of the present invention preferably does not comprise cations selected from the group consisting of potassium, ammonium, and magnesium, more preferably does not comprise cations selected from the group consisting of potassium, ammonium, magnesium, calcium, strontium, and barium, most preferably does not comprise cations selected from the group consisting of potassium, ammonium, and alkaline earth metals. The above mentioned conductivity is preferred because in step (iii) the voltage-operating window of the bath can be maintained comparatively low and, thus, rectifiers with a comparatively small voltage-operating window can be utilized, which is cost efficient. Preferably, the total amount of conductive salts in the passivation solution is in the range 0 to 30 g/L, based on the total volume of the passivation solution, more preferably in the range of 1 to 30 g/L.

According to own experiments, potassium cations and alkaline earth metal ions in many cases cause undesired precipitation in a respective passivation solution. In experiments with ammonium cations in a respective passivation solution it was sometimes observed that after step (iii) in some cases the optical appearance of the outermost layer was negatively affected and stains or blurs occurred.

As mentioned above, the exact composition of trivalent chromium complexes in the aqueous, acidic passivation solution utilized in step (iii) of the method of the present invention is not yet fully understood/known. Therefore, the passivation solution is described in further detail by way of obtaining the trivalent chromium ions therein.

In the method of the present invention said trivalent chromium ions in the aqueous, acidic passivation solution are obtained by chemically reducing hexavalent chromium in the presence of phosphoric acid through at least one reducing agent selected from the group consisting of hydrogen peroxide and organic reducing agents, with the proviso that during or after the chemical reducing the one or more than one organic acid residue anion is present for the first time in the passivation solution.

Typically, hexavalent chromium (usually in form of a dissolved hexavalent chromium compound) is mixed with phosphoric acid to form an aqueous starting solution. Preferably, concentrated phosphoric acid is used. Said chemical reducing is started by adding the necessary total amount of reducing agent for quantitatively reducing the total amount of hexavalent chromium to trivalent chromium ions to form a pre-stage of the passivation solution. After the chemical reducing is carried out or while the chemical reducing is still in progress (i.e. during the chemical reducing) the one or more than one organic acid residue anion (preferably one or more than one corresponding organic acid of said one or more than one organic acid residue anion) is added to the passivation solution (i.e. said one or more than one organic acid residue anion is present for the first time in the passivation solution). Preferred is a method of the present invention, wherein the chemical reducing is not started in the presence of the one or more than one organic acid residue anion and/or the one or more than one organic acid residue anion is not added shortly after the chemical reducing is started.

Thus, preferred is a method of the present invention, wherein the chemical reducing is carried out and started in the presence of phosphoric acid and is started in the absence of the one or more than one organic acid residue anion, said one or more than one organic acid residue anion being present for the first time after the start of the chemical reducing, preferably after at least 90% of the hexavalent chromium is chemically reduced, based on the total molar amount of hexavalent chromium in the passivation solution at the start of the chemical reducing, more preferably after at least 95%, most preferably after at least 99%.

It is preferred that the one or more than one organic acid residue anion is present for the first time shortly before the chemical reducing is completed or after the chemical reducing is completed. This prevents (a) unnecessary decomposition of said one or more than one organic acid residue anion and (b) accumulation of respective decomposition products, which might negatively affect the extent and quality of the corrosion resistance. The term "after at least 90%" denotes 90% or more, including 100% (same applies to 95% and 99%).

Preferred is a method of the present invention, wherein said trivalent chromium ions are obtained by chemically reducing chromium trioxide (i.e. $CrO_3$). In an aqueous solution, chromium trioxide forms at least partly $H_2CrO_4$ and its corresponding deprotonated forms.

The chemical reducing of hexavalent chromium into trivalent chromium is carried out through at least one reducing agent selected from the group consisting of hydrogen peroxide and organic reducing agents. In the context of the present invention, hydrogen peroxide is considered as an inorganic reducing agent.

Preferably, the at least one organic reducing agent is different from the one or more than one organic acid residue anion (including corresponding organic acids of said residue anions).

Preferred is a method of the present invention, wherein the at least one reducing agent is or at least comprises hydrogen peroxide, preferably with the proviso that hydrogen peroxide is the primary reducing agent if trivalent chromium ions are obtained through more than one reducing agent. The term "primary reducing agent" denotes that quantitatively most of the hexavalent chromium is chemically reduced by means of hydrogen peroxide. In such a case, reducing agents other than hydrogen peroxide are selected from the group of organic reducing agents. Preferably, for the chemical reducing only one reducing agent is used, most preferably hydrogen peroxide. Generally, reducing agents utilized in the method of the present invention are not sufficient to reduce trivalent chromium to metallic chromium. However, reducing agents chemically reducing hexavalent chromium to trivalent chromium ions usually strongly decompose during that process, ideally largely into carbon dioxide.

Organic reducing agents typically contain carbon atoms. Preferably, the total amount of organic reducing agents for chemical reducing is selected (and added) such that the aqueous, acidic passivation solution does not contain or accumulate (i) carbon containing decomposition products of said organic reducing agents and (ii) unreacted organic reducing agents. This keeps the passivation solution free of undesired contaminations. In contrast, hydrogen peroxide, which is a very effective reducing agent, only consists of hydrogen and oxygen. Thus, there is no danger of contamination with carbon containing decomposition products. Therefore, hydrogen peroxide is the preferred reducing agent.

Preferred is a method of the present invention, wherein said organic reducing agents are selected from the group consisting of alcohols, aldehydes, carboxylic acids, and carbohydrates, preferably selected from the group consisting of alcohols, aldehydes and carbohydrates. Carboxylic acids are less preferred; preferably the at least one reducing agent does not comprise glycolic acid. Among the organic reducing agents alcohols and carbohydrates are preferred, alcohols are most preferred.

Preferred alcohols are selected from the group consisting of monohydric alcohols, dihydric alcohols, and trihydric alcohols.

Preferred monohydric alcohols comprise a total amount of 1 to 6 carbon atoms, more preferably 1 to 3 carbon atoms, most preferably they are selected from the group consisting of methanol and propanol. However, in some cases a method of the present invention is preferred, wherein the at least one reducing agent does not comprise methanol.

Preferred dihydric alcohols comprise a total amount of 2 to 6 carbon atoms, more preferably 2 to 3 carbon atoms, most preferably they are selected from the group consisting of ethylene glycol and propylene glycol. In some cases polymers thereof are preferred.

Preferred trihydric alcohols comprise a total amount of 3 to 6 carbon atoms, more preferably 3 carbon atoms, most preferably the trihydric alcohol is glycerol.

Preferred aldehydes are selected from the group consisting of mono-aldehydes and dialdehydes, preferably mono-aldehydes. Preferred mono-aldehydes comprise a total amount of 1 to 6 carbon atoms, more preferably 1 to 4 carbon atoms, most preferably they are selected from the group consisting of formaldehyde, acetaldehyde, propionaldehyde, and butyraldehyde.

Preferred carbohydrates are selected from the group consisting of monosaccharides, disaccharides, and starches.

The total amount of reducing agent (i.e. the total sum of all reducing agents) is selected such that hexavalent chromium is at least quantitatively reduced, preferably the total amount of hydrogen peroxide is selected such that hexavalent chromium is at least quantitatively reduced.

After the chemical reducing is completed, the total amount of reducing agent in the passivation solution is preferably below 1 wt.-%, based on the total weight of the passivation solution, more preferably the total amount of hydrogen peroxide in the passivation solution is below 1 wt.-%, based on the total weight of the passivation solution, even more preferably the total amount of hydrogen peroxide is below 0.1 wt.-%.

In the method of the present invention the chemical reducing is carried out in the presence of phosphoric acid and with the proviso that during or after the chemical reducing the one or more than one organic acid residue anion is present for the first time in the passivation solution (as described above in the text in more detail). Preferred is a method of the present invention, wherein the one or more than one organic acid residue anion is obtained from corresponding organic acids, preferably obtained from carboxylic acids, more preferably obtained from carboxylic acids comprising at least oxalic acid. Most preferred is that the organic acid residue anion is oxalate, the corresponding organic acid oxalic acid.

Even more preferred is a method of the present invention, wherein

- the aqueous, acidic passivation solution comprises oxalate, and
- the chemical reducing is carried out and started in the presence of phosphoric acid and is started in the absence of oxalate (preferably oxalic acid), oxalate being present for the first time after the start of the chemical reducing, preferably after at least 90% of the hexavalent chromium is chemically reduced, based on the total molar amount of hexavalent chromium in the passivation solution at the start of the chemical reducing, more preferably after at least 95%, most preferably after at least 99%.

In some cases a method of the present invention is preferred, wherein in step (ii) the chemical reducing is not carried out in the additional presence of an inorganic acid other than phosphoric acid, more preferably not in the additional presence of one or more than one of inorganic acids selected from the group consisting of hydrochloric acid, nitric acid and sulfuric acid. It is preferred to not have too many different ion species in the passivation solution during the manufacturing of the passivation solution; in particular not too many anion species of inorganic acids. Preferably, salts of inorganic acids other than phosphoric acid are added to the passivation solution at a later stage, for example in order to affect the conductivity of the passivation solution (for conductivity salts see the text above). However, little amounts of one or more than one inorganic acid other than phosphoric acid are usually not harmful but less preferred.

In a particular case, the method of the present invention includes in step (ii) manufacturing the aqueous, acidic passivation solution. In this particular case, a method for electrolytically passivating an outermost chromium or outermost chromium alloy layer to increase corrosion resistance thereof is preferred, the method comprising the steps of (i) providing a substrate comprising an outermost chromium or outermost chromium alloy layer (preferably as described throughout the text), preferably obtained from electrolytically deposited trivalent chromium ions, (ii) manufacturing an aqueous, acidic passivation solution comprising
trivalent chromium ions,
phosphate ions,
one or more than one organic acid residue anion,
the manufacturing comprising
chemically reducing hexavalent chromium in the presence of phosphoric acid through at least one reducing agent such that said trivalent chromium ions are obtained, the reducing agent being selected from the group consisting of hydrogen peroxide and organic reducing agents,
adding during or after the chemical reducing the one or more than one organic acid residue anion (preferably one or more than one corresponding organic acid of said one or more than one organic acid residue anion) to the passivation solution with the proviso that said one or more than one organic acid residue anion is present in the passivation solution for the first time, (iii) contacting the substrate with the passivation solution and passing an electrical current between the substrate as a cathode and an anode in the passivation solution such that a passivation layer is deposited onto the outermost layer.

The above and below mentioned regarding the method of the present invention in general (including its preferred features and embodiments) applies likewise to this particular case.

In step (iii) of the method of the present invention the substrate (operated as cathode) is contacted with the passivation solution (preferably by immersing the substrate into the passivation solution) and an electrical current is passed between the substrate and the anode (the anode is also typically immersed into the passivation solution) such that a passivation layer is deposited onto the outermost layer.

Preferred is a method of the present invention, wherein in step (iii) the anode is selected from the group consisting of mixed metal oxide coated anodes, graphite anodes, and steel anodes, most preferably mixed metal oxide coated anodes. In particular preferred are insoluble anodes such as mixed metal oxide coated anodes. According to own experiments, in the method of the present invention, mixed metal oxide coated anodes exhibit a comparatively low rate of anodic oxidation of trivalent chromium to undesired hexavalent chromium. Preferably, the method of the present invention is carried out in such a way that the total amount of hexavalent chromium in the aqueous, acidic passivation solution (if at all anodically formed in step (iii)) remains below detection level while the method of the present invention is carried out (for detecting hexavalent chromium see text above). This can be achieved by using said mixed metal oxide coated anodes. Preferred mixed metal oxide coated anodes comprise one or more than one oxide selected from the group consisting of titanium oxide, iridium oxide, ruthenium oxide, and platinum oxide.

The electrical current in step (iii) is preferably a direct current, more preferably not including pulses. However, this current as well as the total amount of trivalent chromium ions in the passivation solution is not sufficient to deposit metallic chromium in step (iii) onto the outermost layer. This means that the passivation layer is not an additional metallic chromium layer but rather a layer of compounds containing trivalent chromium.

Preferred is a method of the present invention, wherein in step (iii) the cathodic current density of the electrical current is in the range from 0.1 to 8 $A/dm^2$, preferably 0.1 to 5 $A/dm^2$, more preferably 0.2 to 3 $A/dm^2$, most preferably 0.3 to 2 $A/dm^2$. If the current density is significantly below 0.1 $A/dm^2$ no sufficient passivation effect is obtained. If the current density significantly exceeds 8 $A/dm^2$ undesired changes in the optical appearance of the outermost layer, such as stains and blurs, are sometimes observed and are accompanied by an insufficient passivation effect.

Preferred is a method of the present invention, wherein in step (iii) the electrical current is passed for 10 to 300 seconds, preferably 10 to 240 seconds, more preferably 15 to 120 seconds, most preferably 20 to 60 seconds. If the length of time is significantly below 10 seconds no sufficient passivation effect is obtained. If the length of time significantly exceeds 300 seconds undesired changes in the optical appearance of the outermost layer, such as stains and blurs, are observed in some cases.

Preferred is a method of the present invention, wherein in step (iii) the temperature of the passivation solution is in the range from 20° C. to 40° C., preferably 20° C. to 30° C. If the temperature significantly exceeds 40° C. undesired changes in the optical appearance of the outermost layer, such as stains and blurs, are sometimes observed and are accompanied by an insufficient passivation effect.

In the method of the present invention (as described above, preferably as described as being preferred) it is preferred that in step (iii) the passivation layer is deposited in a single step without interruption.

Preferably, the passivation layer obtained after step (iii) has a maximum layer thickness of 4 nm or less, more preferably of 3 nm or less, most preferably of 2 nm or less.

According to own experiments, the passivation layer deposited in step (iii) typically comprises the elements chromium, carbon, oxygen and phosphorous. Thus, the passivation layer is a phosphorous containing passivation layer, preferably containing phosphorous in a total amount of 40 atom-% or less, based on the total amount of atoms in the passivation layer, more preferably of 30 atom-% or less, even more preferably of 20 atom-% or less, most preferably of 10 atom-% or less. The words "or less" do not include zero, i.e. in each case phosphorous is present.

The invention is further explained by the following non-limiting examples.

EXAMPLES

ABS base-substrates of identical size and each with a layer-stack on its surface were used throughout all examples, the layer stack comprising a copper layer, a semi-bright nickel layer, a bright nickel layer, a non-conductive particle containing nickel layer ("microporous nickel layer"), and a bright chromium layer as the outermost layer. Thus, a substrate as defined in step (i) of the method of the present invention was provided.

If a passivation step was carried out, identical insoluble, mixed metal oxide coated anodes were utilized throughout respective examples.

In order to evaluate corrosion resistance, in each example, neutral salt spray tests (NSS-test) were carried out according to ISO 9227 with varying time lengths. Typical time lengths are for example 240, 480, and 720 hours. The results for respective time lengths are summarized in Table 1 in the text below.

Prior to and after each NSS-test, the optical appearance of the outermost layer was visually and systematically inspected.

After each NSS-test, the substrates were rinsed with water, dried and visually inspected in order to determine/quantify the change of optical appearance (expressed as an area of defects determined by means of a caliber plate). If no change of optical appearance (including a change of optical appearance in up to 0.1% of the entire surface of the outermost layer) was observed, a test was considered as "passed". In contrast, if a change of optical appearance in more than 0.1% of the entire surface of the outermost layer was observed, the test was considered as "failed".

Example 1 (Comparative)

A substrate as defined above was subjected to the above mentioned NSS-test. No pre-treatment and no contacting with a passivation solution as for example defined in step (iii) of the method of the present invention were carried out.

Example 2 (Comparative)

Pre-treatment (i.e. immersion without an electrical current prior to passivation treatment):

no pre-treatment was carried out

Passivation step (i.e. including an electrical current):

Passivation solution (not according to the invention):

5 g/L $Cr^{3+}$, 28.5 g/L $PO_4^{3-}$, 10 g/L oxalate

Temperature: 25° C., pH: 3.5 electrical current: 1 A/dm$^2$ for 30 seconds, the substrate being the cathode

The passivation solution was made up by dissolving chromium-(III) phosphate and oxalic acid with subsequent mixing for 3 hours at 80° C. and a final pH-adjustment with sodium hydroxide.

The optical appearance of the outermost layer did not change due to the passivation treatment.

Example 2 is based on JP 2009-235456 A and JP 2010-209456 A, respectively. Our results obtained for Example 2 confirm the results disclosed in JP-2009 and JP-2010.

Example 3 (Comparative)

Pre-treatment (i.e. immersion without an electrical current prior to passivation treatment):

Aqueous immersion treatment solution:

10 g/L $Cr^{3+}$, 80 g/L $PO_4^{3-}$, 15 g/L malic acid

Temperature: 25° C., pH: 1.3 immersion for 10 seconds

Passivation step (i.e. including an electrical current):

identical to Example 2

The optical appearance of the pre-treated outermost layer did not change due to the passivation treatment.

Example 3 is based on JP 2010-209456 A. Our results obtained for Example 3 confirm the results disclosed in JP-2010, in particular of "Embodiment 14" in JP-2010.

Example 4 (Comparative)

Pre-treatment (i.e. immersion without an electrical current prior to passivation treatment):

no pre-treatment was carried out

Passivation step (i.e. including an electrical current):

Passivation solution (not according to the invention):

4.4 g/L $Cr^{3+}$, 9.9 g/L $PO_4^{3-}$, 9.7 g/L oxalate

Temperature: 25° C., pH: 3.5 electrical current: 1 A/dm$^2$ for 30 seconds, the substrate being the cathode

The passivation solution was made up by dissolving chromium-(III) phosphate and chromium-(III) oxalate with subsequent mixing for 3 hours at 80° C. and a final pH-adjustment with sodium hydroxide.

The optical appearance of the outermost layer did not change due to the passivation treatment.

Example 5 (Comparative)

Pre-treatment (i.e. immersion without an electrical current prior to passivation treatment):

identical to Example 3

Passivation step (i.e. including an electrical current):

identical to Example 4

The optical appearance of the pre-treated outermost layer did not change due to the passivation treatment.

Example 6 (Comparative)

Pre-treatment (i.e. immersion without an electrical current prior to passivation treatment):

identical to Example 3

Passivation step (i.e. including an electrical current):

Passivation solution (not according to the invention):

5 g/L $Cr^{3+}$, 13 g/L $PO_4^{3-}$, 10 g/L oxalate, 13 g/L $SO_4^{2-}$

Temperature: 25° C., pH: 3.5 electrical current: 0.2 A/dm$^2$ for 30 seconds, the substrate being the cathode The optical appearance of the pre-treated outermost layer became slightly darker due to the passivation treatment.

The passivation solution was made up by dissolving chrometane (basic chromium sulfate), phosphoric acid and oxalic acid with subsequent mixing for 3 hours at 80° C. and a final pH-adjustment with sodium hydroxide.

Example 7 (According to the Invention)

Pre-treatment (i.e. immersion without an electrical current prior to passivation treatment):

no pre-treatment was carried out

Passivation step (i.e. including an electrical current):

Passivation solution (according to the invention):

4.9 g/L $Cr^{3+}$, 9.5 g/L $PO_4^{3-}$, 7.5 g/L oxalate

Temperature: 25° C., pH: 3.5 electrical current: 1 A/dm$^2$ for 30 seconds, the substrate being the cathode

The passivation solution (as defined in step (ii) of the method of the present invention) was made up by reducing $CrO_3$ with $H_2O_2$ and subsequent addition of oxalic acid and a final pH-adjustment with sodium hydroxide.

The optical appearance of the outermost layer did not change due to the passivation treatment.

Example 8 (According to the Invention)

Pre-treatment (i.e. immersion without an electrical current prior to passivation treatment):

identical to Example 3

Passivation step (i.e. including an electrical current):

identical to Example 7

The optical appearance of the outermost layer did not change due to the passivation treatment.

Example 9 (According to the Invention)

Pre-treatment (i.e. immersion without an electrical current prior to passivation treatment):

no pre-treatment was carried out

Passivation step (i.e. including an electrical current):

Passivation solution (according to the invention):

4.9 g/L $Cr^{3+}$, 47 g/L $PO_4^{3-}$, 7.5 g/L oxalate

Temperature: 25° C., pH: 3.5 electrical current: 1 A/dm$^2$ for 30 seconds, the substrate being the cathode

The passivation solution (as defined in step (ii) of the method of the present invention) was made up by reducing $CrO_3$ with $H_2O_2$ and subsequent addition of oxalic acid and a final pH-adjustment with sodium hydroxide.

The optical appearance of the outermost layer did not change due to the passivation treatment.

Example 10 (According to the Invention)

Pre-treatment (i.e. immersion without an electrical current prior to passivation treatment):

identical to Example 3

Passivation step (i.e. including an electrical current):

identical to Example 9

The optical appearance of the outermost layer did not change due to the passivation treatment.

In Table 1 all experimental results are summarized.

TABLE 1

Summary of experimental results

| Example | Length of NSS-test [hours] | area of defects [%] | Test passed |
|---|---|---|---|
| 1 | 240 | 5 to 10 | NO |
| 2 | 240 | 1 to 2.5 | NO |
| 3 | 240 | <0.1 | YES |
| | 480 | 0.25 to 0.5 | NO |
| 4 | 240 | 2.5 to 5 | NO |
| 5 | 240 | 2.5 to 5 | NO |
| 6 | 240 | 10 to 25 | NO |
| 7 | 240 | <0.1 | YES |
| | 480 | <0.1 | YES |
| | 720 | <0.1 | YES |
| | 1008 | <0.1 | YES |
| 8 | 240 | <0.1 | YES |
| | 480 | <0.1 | YES |
| | 720 | <0.1 | YES |
| | 1008 | <0.1 | YES |
| 9 | 240 | <0.1 | YES |
| | 480 | <0.1 | YES |
| | 720 | <0.1 | YES |
| 10 | 240 | <0.1 | YES |
| | 480 | <0.1 | YES |
| | 720 | <0.1 | YES |

According to own experiments, corrosion resistance in neutral salt spray tests is significantly increased utilizing the method of the present invention compared to known methods.

The invention claimed is:

1. A method for electrolytically passivating an outermost chromium or outermost chromium alloy layer to increase corrosion resistance thereof, the method comprising the steps of (i) providing a substrate comprising said outermost chromium or outermost chromium alloy layer, (ii) providing or manufacturing an aqueous, acidic passivation solution, the solution comprising trivalent chromium ions, phosphate ions, one or more than one organic acid residue anion, and (iii) contacting the substrate with the passivation solution and passing an electrical current between the substrate as a cathode and an anode in the passivation solution such that a passivation layer is deposited onto the outermost chromium or outermost chromium alloy layer, wherein in the passivation solution said trivalent chromium ions are obtained by chemically reducing hexavalent chromium in the presence of phosphoric acid through at least one reducing agent selected from the group consisting of hydrogen peroxide and organic reducing agents, with the proviso that during or after the chemical reducing the one or more than one organic acid residue anion is present for the first time in the passivation solution, and wherein the chemical reducing is carried out and started in the presence of phosphoric acid and is started in the absence of the one or more than one organic acid residue anion, said one or more than one organic acid residue anion being present for the first time after the start of the chemical reducing.

2. The method of claim 1, wherein in step (i) the outermost layer is (a) directly on a surface of a base-substrate to form the substrate as defined in step (i), or (b) a layer of a layer stack, the layer stack being on a surface of a base-substrate.

3. The method of claim 1, wherein the outermost layer has a maximum layer thickness of 500 nm or less.

4. The method of claim 1, wherein in step (i) the outermost layer is obtained from electrolytically deposited trivalent chromium ions.

5. The method of claim 1, wherein in step (i) the outermost chromium alloy layer comprises a total amount of chromium of 45 atom-% or more, based on the total amount of atoms in the outermost chromium alloy layer.

6. The method of claim 1, wherein the one or more than one organic acid residue anion in the aqueous, acidic passivation solution is selected from the group consisting of organic acid residue anions having one carboxylic moiety, carboxylic acid residue anions having two carboxylic moieties, and carboxylic acid residue anions having three carboxylic moieties.

7. The method of claim 1, wherein the aqueous, acidic passivation solution does not contain boric acid.

8. The method of claim 1, wherein the aqueous, acidic passivation solution does not contain thiocyanate.

9. The method of claim 1, wherein said trivalent chromium ions are obtained by chemically reducing chromium trioxide.

10. The method of claim 1, wherein the at least one reducing agent is or at least comprises hydrogen peroxide.

11. The method of claim 1, wherein the one or more than one organic acid residue anion is obtained from corresponding carboxylic acids.

12. A method for electrolytically passivating an outermost chromium or outermost chromium alloy layer to increase corrosion resistance thereof, the method comprising the steps of (i) providing a substrate comprising said outermost chromium or outermost chromium alloy layer, (ii) providing or manufacturing an aqueous, acidic passivation solution, the solution comprising
trivalent chromium ions,
phosphate ions,
one or more than one organic acid residue anion, and (iii) contacting the substrate with the passivation solution and passing an electrical current between the substrate as a cathode and an anode in the passivation solution such that a passivation layer is deposited onto the outermost chromium or outermost chromium alloy layer, wherein in the passivation solution said trivalent chromium ions are obtained by chemically reducing hexavalent chromium in the presence of phosphoric acid through at least one reducing agent selected from the group consisting of hydrogen peroxide and organic reducing agents, with the proviso that during or after the chemical reducing the one or more than one organic acid residue anion is present for the first time in the passivation solution, wherein the aqueous, acidic passivation solution comprises oxalate, and the chemical reducing is carried out and started in the presence of phosphoric acid and is started in the absence of oxalate, oxalate being present for the first time after the start of the chemical reducing.

13. The method of claim 1, wherein in step (iii) the cathodic current density of the electrical current is in the range from 0.1 to 8 $A/dm^2$.

14. The method of claim 1, wherein the aqueous, acidic passivation solution does not contain sulfur containing compounds comprising a sulfur atom having an oxidation state below +6.

15. The method of claim 1, wherein the one or more than one organic acid residue anion is obtained from carboxylic acids.

16. The method of claim 12 wherein the oxalate is present for the first time after at least 90% of the hexavalent chromium is chemically reduced, based on the total molar amount of hexavalent chromium in the passivation solution at the start of the chemical reducing.

* * * * *